US005107753A

United States Patent [19]

Ioku

[11] Patent Number: 5,107,753

[45] Date of Patent: Apr. 28, 1992

[54] AUTOMATIC PRESSURE CONTROL DEVICE FOR HYDRAULIC ACTUATOR DRIVING CIRCUIT

[75] Inventor: Kensuke Ioku, Kobe, Japan

[73] Assignee: Nippon Air Brake Kabushiki Kaisha, Kobe, Japan

[21] Appl. No.: 742,429

[22] Filed: Aug. 8, 1991

[30] Foreign Application Priority Data

Aug. 8, 1990 [JP] Japan ..... 2-211134

[51] Int. Cl.[5] ..... F15B 13/08

[52] U.S. Cl. ..... 91/512; 91/518; 91/529; 137/596.13; 137/596.14

[58] Field of Search ..... 91/512, 518, 529; 137/596.13, 596.14

[56] References Cited

FOREIGN PATENT DOCUMENTS 1-269704 10/1989 Japan .

*Primary Examiner*—Gerald A. Michalsky
*Attorney, Agent, or Firm*—Morris Fidelman

[57] ABSTRACT

An automatic pressure control device built in a hydraulic actuator driving circuit for driving a plurality of actuators of a construction machine or the like by a single hydraulic pump through respective pilot changeover valves is provided for automatically shuttling the changeover valve of each actuator to reduce its demanded flow rate and uniformly control the operation speeds of all actuators. To this end, the device is arranged to drain an excessive flow rate of the hydraulic pump through a series connection of a flow rate control valve controlled by the highest load pressure of the actuators and a resistance passage including a shuttle and to control the pilot pressure of each pilot changeover valve in response to a pressure at the junction of the series connection.

4 Claims, 4 Drawing Sheets

AUTOMATIC PRESSURE CONTROL DEVICE FOR HYDRAULIC ACTUATOR DRIVING CIRCUIT

BACKGROUND OF THE INVENTION

This invention relates to an automatic pressure control device for a hydraulic driving circuit used for driving a plurality of actuators of a construction machine or the like by a single hydraulic pressure source and, especially, to an automatic control device which serves to control a pilot pressure of each changeover valve in the driving circuit to reduce its aperture, thereby reducing a demanded flow rate of each actuator.

Generally, as shown in FIG. 1, a hydraulic actuator driving circuit of this kind includes a single hydraulic pressure source, such as a hydraulic pump 6, for driving a plurality of actuators, for example two actuators 7 and 8, and changeover valves 1 and 2 inserted between an output passage 14 of the hydraulic pump 6 and input passages 7*b* and 8*b* of the actuators 7 and 8 for controlling flow rates therebetween. The changeover valves 1 and 2 have three changeover positions 1*a*, 1*b*, 1*c* and 2*a*, 2*b*, 2*c* and pairs of main pilot chambers 1*d*, 1*e* and 2*d*, 2*e*, respectively. The main pilot chambers 1*d*, 1*e*, 2*d* and 2*e* are connected respectively through passages 10, 11, 12 and 13 to the outlets of proportional control valves 3*a*, 3*b* and 4*a*, 4*b* which are alternately controlled by levers 3 and 4 for selectively receiving a hydraulic pressure from a pilot pump 5 to move the changeover valves 1 and 2 from their neutral positions 1*b* and 2*b* as shown to either left or right changeover position to drive the actuators 7 and 8 forwards or backwards. The outlet of the hydraulic pump 6 is also connected through a bypass flow rate control valve 9 to a tank T. The bypass flow rate control valve 9 has a spring chamber 9*a* provided with a spring 9*b* and the spring chamber 9*a* is connected through a passage 22 to a shuttle valve 21. The shuttle valve 21 has two (generally, plural) inlets for receiving load pressures of the actuators 7 and 8 through passages 19 and 20 and the changeover valves 1 and 2 and an outlet for delivering the highest of them. The bypass flow rate control valve 9 serves a function of responding to this highest load pressure to drain part of the output pressure of the pump to the tank T. Check valves 15 and 16 and inline flow rate control valves 17 and 18 are inserted between the pump 6 and the changeover valves 1 and 2, respectively.

Although there is no problem in such prior art driving circuit when the total flow rate demanded by the actuators is less than a power limit or the maximum flow rate of the pump 6, there is a problem of an actuator of a lower load being preferentially operated due to a deficiency in the amount of feed when the demanded total flow rate exceeds the power limit of the pump. In order to remove this problem, such an automatic control device has been developed in that the apertures of the changeover valves are reduced for reducing the demanded flow rates of the respective actuators when the demanded total flow rate of the actuators exceeds the power limit of the pump. An example of this kind of device is disclosed in Japanese opened patent gazette No. H1-269704. This control device comprises a pair of counter pilot chambers disposed in both sides of each changeover valve in addition to the main pilot chambers, a pair of passages for connecting the main pilot chambers to the counter pilot chambers in the opposite side of the main pilot chambers, respectively, and a pair of pressure reducing valves inserted in these passages for operating in response to a difference between the output pressure and the highest load pressure of the actuators. When the demanded total flow rate of the actuators exceeds the power limit or the maximum flow rate of the pump in this device, the difference between the output pressure of the pump and the highest load pressure becomes low. This reduction is sensed by the pressure reducing valves which raise the pressures of the counter pilot chambers to move the changeover valves toward their neutral positions to reduce their apertures. Accordingly, it is possible to reduce the demanded total flow rate without substantial reduction in the operation speed of the actuator of low demanded flow rate.

However, this control device has such a disadvantage in that it is complicated in structure and expensive since it uses changeover valves of a special structure having counter pilot chambers and special pressure reducing valves of differential operation type.

Accordingly, an object of this invention is to provide an economical control device of simple structure which can effect a similar operation without use of any valve of such a special structure as above.

SUMMARY OF THE INVENTION

The control device according to this invention includes a parallel connection of a first throttle and a relief or check valve connected between the outlet of the bypass flow rate control valve and the tank, and a pair of two-position three-direction valves inserted between the main pilot chambers of each changeover valve and the proportional control valves. Each two-position three-direction valve includes a pilot chamber for receiving a hydraulic pressure at a point between the bypass flow rate control valve and the first throttle, a spring opposing to the hydraulic pressure, and second and third throttles, so that the main pilot chamber is connected directly to the proportional control valve when the hydraulic pressure overcomes the urging force of the spring and the main pilot chamber is connected to the proportional control valve through the second throttle and to the tank through the third throttle.

These and other features and operation of this invention will be described in detail below in connection with its embodiment with reference to the accompanying drawings.

BRIEF DESCRIPTION OF THE DRAWINGS

In the drawings.

Throughout the drawings, similar reference symbols are given to corresponding structural components.

DESCRIPTION OF PREFERRED EMBODIMENTS

Figure 1:
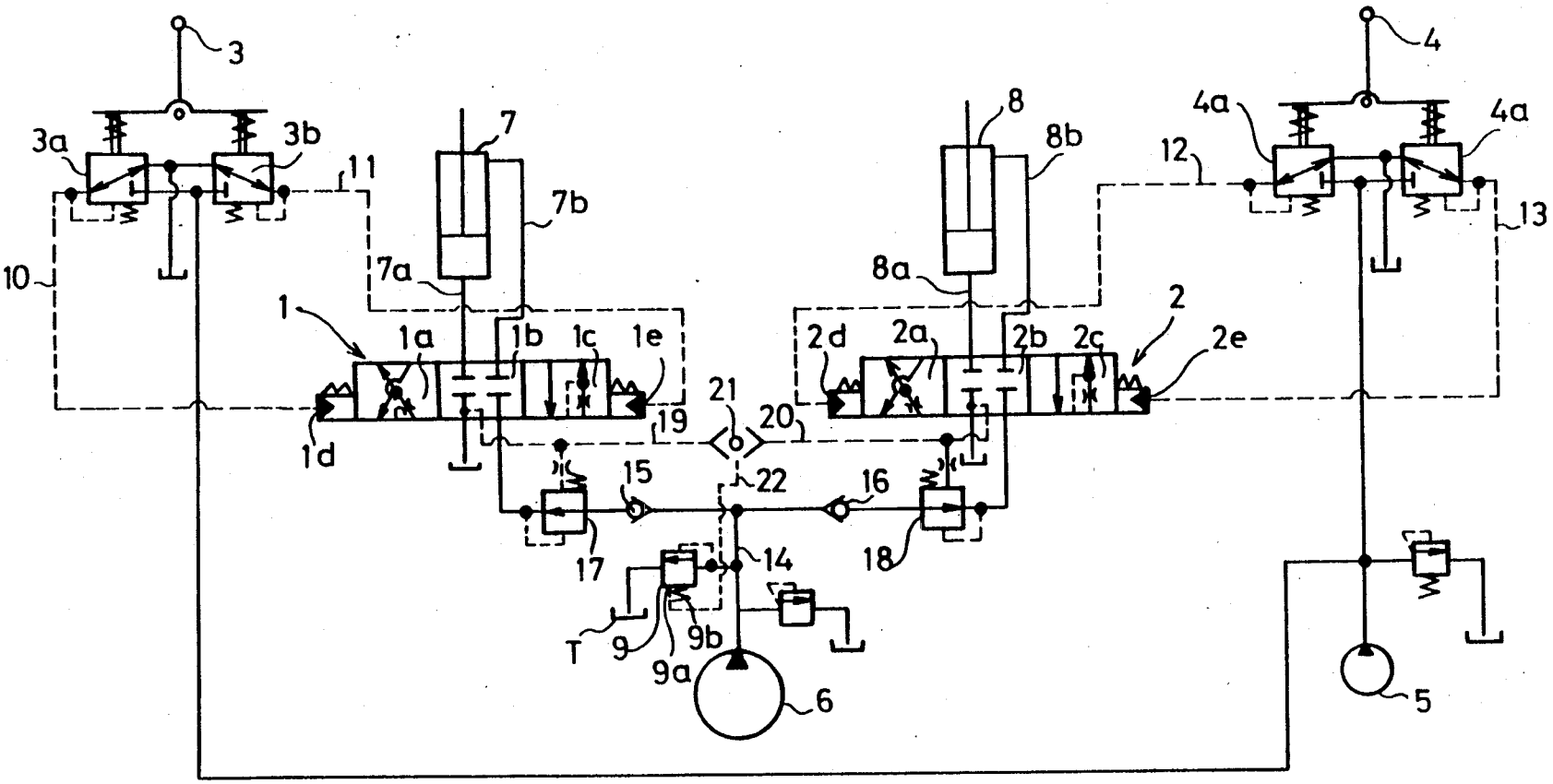
FIG. 1 (PRIOR ART)
FIG. 1 is a schematic diagram showing a hydraulic actuator driving circuit according to the prior art.
Figure 2:
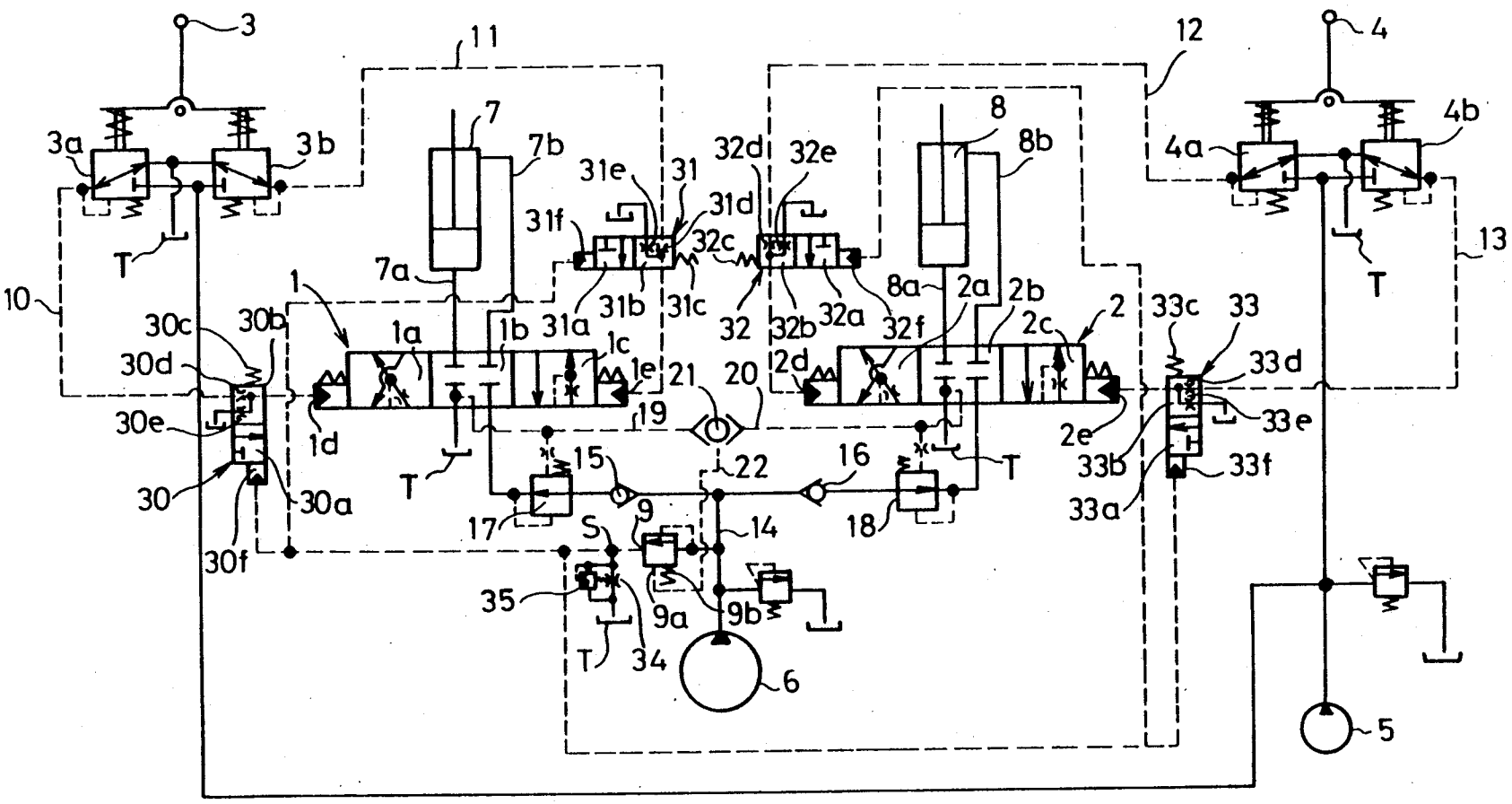
FIG. 2 is a schematic diagram showing the hydraulic actuator driving circuit of FIG. 1 including an embodiment of this invention.

As the embodiment of FIG. 2 is identical in structure to the prior art actuator driving circuit of FIG. 1, excepting some new components added for the control device of this invention, the components described above with reference to FIG. 1 will not be described again.

As a feature of this invention, as shown, a bypath consisting of a parallel connection of a first throttle 34 and a relief valve 35 is inserted between the outlet of the bypass flow rate control valve 9 and the tank T. Two-position three-direction valves 30 and 31 are inserted respectively in the passages 10 and 11 between the main pilot chambers 1*d* and 1*e* of the changeover valve 1 and the proportional control valves 3*a* and 3*b*, and two-position three-direction valves 32 and 33 are inserted respectively in the passages 12 and 13 between the main pilot chambers 2*d* and 2*e* of the changeover valve 2 and the proportional control valves 4*a* and 4*b*. The two-position three-direction valve 30 includes first and second changeover positions 30*a* and 30*b*, a spring 30*c* for urging this valve to the second changeover position 30*b* and a pilot chamber 30*f* for urging this valve to the first changeover position 30*a*, and the pilot chamber 30*f* is connected to a joint S of the outlet of the bypass flow rate control valve 9 and the bypath consisting of the first throttle 34 and relief valve 35. The second changeover position 30*b* includes second and third throttles 30*d* and 30*e* and the two-position three-direction valve 30 connects the outlet of the proportional control valve 3*a* directly to the main pilot chamber 1*d* at its first changeover position and, as shown, connects the outlet of the proportional control valve 3*a* through the second throttle 30*d* to the main pilot chamber 1*d* and also the main pilot chamber 1*d* through the third throttle 30*e* to the tank T.

Figure 3:
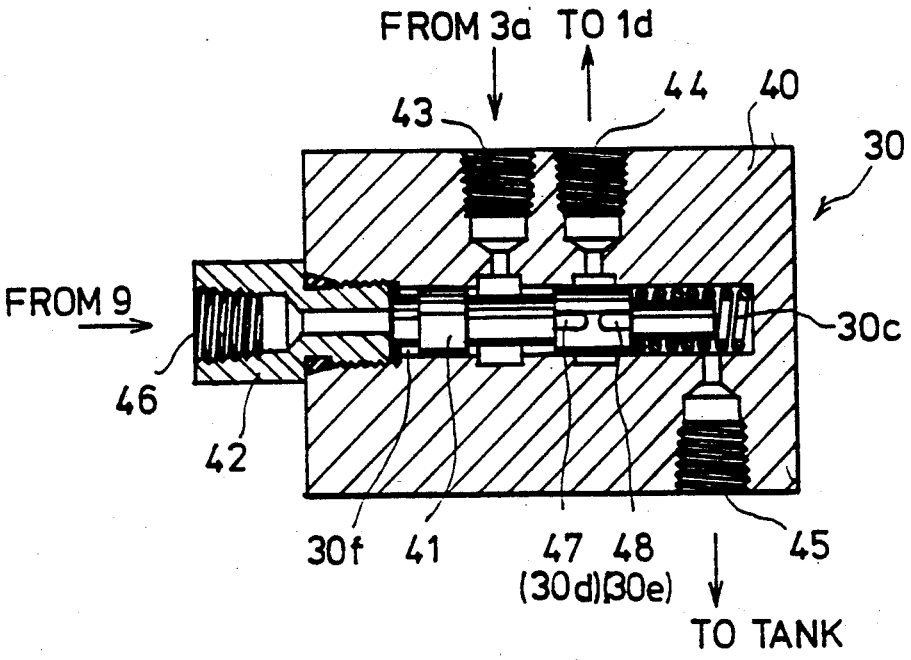
FIGS. 3(*a*) and (*b*) are sectional views showing an example of concrete structure of the two-position three-direction valve, in different states, which is used in the embodiment of FIG. 2.
Figure 3:
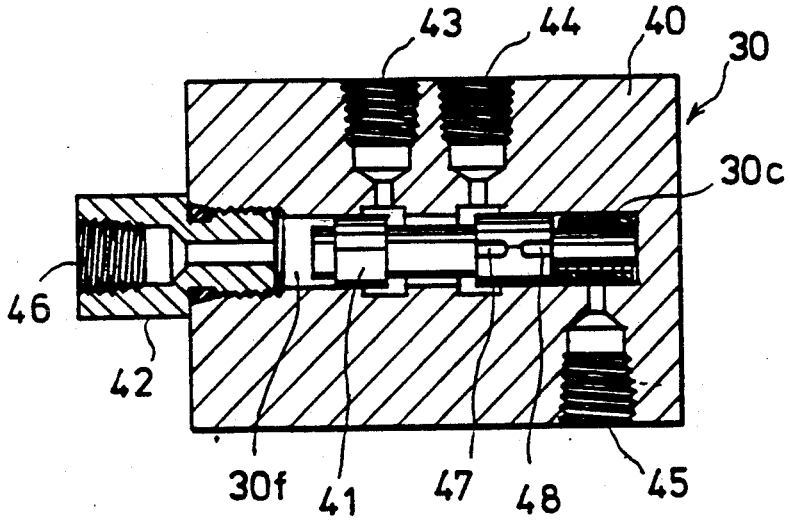
Figure 4:
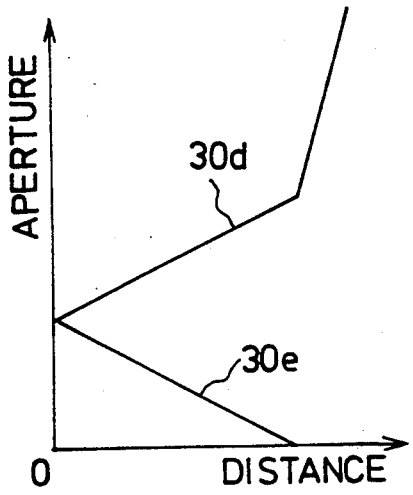
FIG. 4 is a diagram showing a relationship between the distance of movement of the spool and the apertures of the second and third throttles of the two-position three-direction valve of FIG. 3.

As shown in FIGS. 3(*a*) and (*b*), the two-position three-direction valve 30 has a spring 30*c* and a spool 41 inserted in an inner hole of its main body 40 and joint holes 43, 44, 45 and 46 connecting with the inner hole. The joint holes 43, 44, 45 and 46 are provided for connection to the proportional control valve 3*a*, main pilot chamber 1*d*, tank T and joint S, respectively. The spool 41 has notches 47 and 48 which form the second and third throttles 30*d* and 30*e*, respectively, in its outer face. FIG. 3(*a*) shows the spool 41 which is urged by the spring 30*c* to the second changover position to connect the joint hole 44 through the throttles 30*d* and 30*e* to the joint holes 43 and 45, respectively, while the FIG. 3(*b*) shows the spool 41 which is urged by the pilot pressure to the first changeover position to connect the joint hole 43 directly to the joint hole 44. While the second and third throttles 30*d* and 30*e* have substantially same apertures at its second changeover (zero) position as shown in FIG. 4, they change their apertures as shown with rightward movement of the spool 41. The other two-position three-direction valves 31, 32 and 33 will not be described here since they are identical in structure and connection to the above-mentioned two-position three-direction valve 30.

Figure 5:
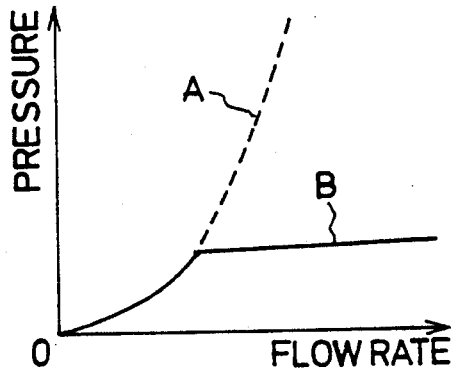
FIG. 5 is a diagram showing a relationship between the flow rate of the bypath and the throttle pressure in the embodiment of FIG. 2.

Now, operation of the embodiment of FIG. 2 will be described below. When the control lever 3 of the proportional control valves 3*a* and 3*b* and the control lever 4 of the proportional control valves 4*a* and 4*b* are both at their neutral positions as shown, both main pilot chambers 1*d* and 1*e* of the changeover valve 1 and both main pilot chambers 2*d* and 2*e* of the changeover valve 2 are connected concurrently to the tank T to keep both changeover valves 1 and 2 at their neutral positions 1*b* and 2*b*. Accordingly, the load detecting passages 19 and 20 are connected also to the tank T to transfer a low tank pressure to the spring chamber 9*b* of the bypass flow rate control valve 9 through the shuttle valve 21 and passage 22. Therefore, the pressurized oil from the pump 6 opens the bypass flow rate control valve 9 by its pressure as low as it overcomes the spring 9*b* and returns to the tank T through the bypath of 34 and 35. At this time, a pressure which is hereinunder referred to as "throttle pressure" appears at the joint S. FIG. 5 is a diagram showing a relationship between the flow rate of the bypath and the throttle pressure and it is understood that the flow rate increases abruptly as shown by curve A when the bypath consists of the first throttle 34 only but an excessive flow is bypassed through the added relief valve 35 to prevent pressure loss as shown by curve B. The throttle pressure is applied to the pilot chambers 30*f* and 31*f* of the two-position three-direction valves 30 and 31 and the pilot chambers 32*f* and 33*f* of the two-position three-direction valves 32 and 33 and, when its value exceeds a predetermined value, moves the valves 30, 31, 32 and 33 to their first changeover positions 30*a*, 31*a*, 32*a* and 33*a*, respectively, against the springs 30*c*, 31*c*, 32*c* and 33*c*. However, when the control levers 3 and 4 of the proportional control valves 3*a*, 3*b* and 4*a*, 4*d* are at their neutral positions as shown, the changeover valves 1 and 2 are also kept at their neutral positions and the pressurized oil from the pump 6 returns also to the tank T through the bypass circuit of 9, 34 and 35 to keep the pilot pressure of each two-position three-direction valve higher than its spring pressure. If the proportional control valve control lever 3 or 4 is operated in this condition, the actuator 7 or 8 is driven at a speed corresponding to the amount of operation of the lever.

For example, if the control lever 3 is turned to the left to activate the control valve 3*a* for applying the output of the pilot pump 5 to the pilot chamber 1*d* of the changeover valve 1, the changeover valve 1 turns to the changeover position 1*a* and the pressurized oil from the pump 6 is supplied through the check valve 15, flow rate control valve 17 and passage 7*a* to the actuator 7. Then, the load pressure of the passage 7*a* of the actuator 7 is applied through the shuttle valve 21 to the spring chamber 9*a* of the bypass flow rate control valve 9. Thus, the control valve 9 is throttled and the output pressure of the pump 6 is raised to drive the actuator 7. If the output flow rate of the pump 6 is greater than the demanded flow rate of the actuator 7 plus a certain value in this condition, the throttle pressure becomes also higher than the above-mentioned value and all two-position three-direction valves are kept in their first changeover positions.

If, for example, the control lever 4 is then turned to the right to activate the control valve 4*b* to apply the output of the pilot pump 5 to the pilot chamber 2*e* of the changeover valve 2, the changeover valve 2 turns to its changeover position 2*c* and the pressurized oil from the pump 6 is supplied through the check valve 16, flow rate control valve 18 and passage 8*b* to the actuator 8. While the load pressure of the passage 8*a* of the actuator 8 is also applied to the shuttle valve 21, it is applied through the passage 22 to the spring chamber 9*a* of the bypass flow rate control valve 9 to further throttle the valve 9 if it is higher than the load pressure of the actuator 7. Accordingly, the output pressure of the pump 6 rises further and the flow rate control valve 17 is throttled correspondingly to prevent increase of the load pressure of the actuator 7. Even in this condition, all two-position three-direction valves are kept in their first changeover positions, if the output flow rate of the pump 6 is greater than the demanded total flow rate of the actuators 7 and 8 plus a predetermined value.

If the control lever 4 of the actuator 8 is turned further to increase the aperture of the changeover valve 2 for raising its flow rate, the demanded total flow rate of the actuators 7 and 8 approaches the output flow rate of the pump 6 and the bypass flow rate control valve 9 is correspondingly throttled to reduce the throttle pressure at the joint S. If the throttle pressure comes below a certain value, the spring of each two-position three-direction valve overcomes its pilot pressure to turn the valve to its second changeover position. Then, the pressurized pilot oils from the control valves 3*a* and 4*b* are supplied respectively through the second throttles 30*d* and 33*d* of the two-position three-direction valves 30 and 33 to the main pilot chambers 1*d* and 2*e* of the changeover valves 1 and 2 and also returned to the tank T through the third throttles 30*e* and 33*e*. Therefore, the pilot pressures of the pilot chambers 1*d* and 2*e* are reduced in response to the apertures of the respective throttles to draw back the changeover valves 1 and 2 to their neutral positions. This results in simultaneous reduction of the flow rates to the actuators 7 and 8, thereby preventing such a disadvantage in that only the actuator 8 of higher load pressure reduces its operation speed or stops its operation.

Figure 6:
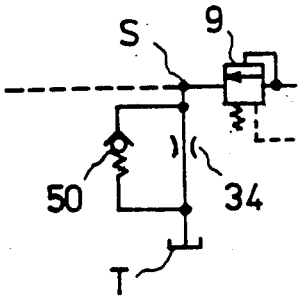
FIG. 6 is a schematic diagram showing a variation of the bypath of the embodiment of FIG. 2.
Figure 7:
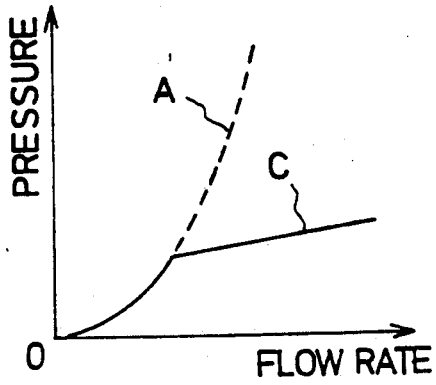
FIG. 7 is a diagram showing a relationship between the flow rate of the bypath and the throttle pressure of FIG. 6.

The relief valve 35 in the bypath of the above-mentioned embodiment may be substituted with a check valve 50 as shown in FIG. 6. In this case, the relationship between the bypass flow rate and the throttle pressure is as shown by curve C in FIG. 7 and is substantially similar to the case of relief valve 35 of FIG. 5.

While two actuators 7 and 8 are used in the embodiment of FIG. 2, it is also the case when three or more actuators are driven at the same time. More particularly, if the total of the demanded flow rates of all actuators approaches the maximum flow rate of the pump 6, the bypass flow rate is reduced to reduce the throttle pressure. Accordingly, all two-position three-direction valves move toward their second changeover positions to reduce the main pilot pressures of the actuator changeover valves. Therefore, the actuator changeover valves move toward their neutral positions to reduce their apertures. Thus, the demanded flow rates of all actuators can be reduced to prevent the total of them from exceeding the power limit of the pump.

The above-mentioned embodiment has been provided for illustrative purpose only and does not mean any limitation to the invention. It should be obvious to those skilled in the art that various modification and changes can be made on this embodiment within the scope of invention which is defined by the appended claims.

I claim:

1. An automatic pressure control device used in a hydraulic actuator driving circuit comprising a single hydraulic pressure source, at least one hydraulic pilot changeover valve provided with a pair of main pilot chambers and inserted between said hydraulic pressure source and each corresponding said actuator of said circuit, proportional control valves for supplying pressurized pilot oil to said main pilot chambers of each pilot changeover valve, and a flow rate control valve inserted between said hydraulic pressure source and a tank and controlled in response to a highest load pressure of at least one said actuator of said circuit; comprising a resistance passage including at least a first throttle and being inserted between said flow rate control valve and said tank, control valve means inserted in a pressurized pilot oil passage between each proportional control valve and each main pilot chamber for controlling a flow rate of the pressurized pilot oil in response to a pressure at an outlet of said flow rate control valve.

2. A device as set forth in claim 1, wherein each said control valve means comprises a two position three direction throttle valve which includes first and second changeover positions, a pilot chamber receiving a pilot pressure from a joint of said flow rate control valve and said resistance passage for urging said throttle valve toward said first changeover position, a spring opposing to said pilot pressure for urging said throttle valve toward said second changeover position having second and third throttles, and which is arranged to connect said proportional control valve directly to said main pilot chamber when it is in said first changeover position, and connect said proportional control valve to said main pilot chamber through said second throttle and said main pilot chamber to said tank through said third throttle.

3. A device as set forth in claim 1, wherein said resistance passage comprises a relief valve connected in parallel with said first throttle.

4. A device as set forth in claim 1, wherein said resistance passage comprises a check valve connected in parallel with said first throttle.

* * * * *